US005590458A

United States Patent [19]

Mohme

[11] Patent Number: 5,590,458

[45] Date of Patent: Jan. 7, 1997

[54] LOCKING SYSTEM FOR SECURING A CABLE TERMINAL IN A PLUG CASE

[75] Inventor: Heinrich Mohme, Vlotho, Germany

[73] Assignee: TSK Prüfsysteme GmbH, Porta Westfalica, Germany

[21] Appl. No.: 493,651

[22] Filed: Jun. 22, 1995

[51] Int. Cl.[6] ..... H01R 43/20

[52] U.S. Cl. ..... 29/748; 29/750; 29/753; 29/754; 7/107

[58] Field of Search ..... 29/33 M, 235, 29/258, 264, 747, 748–754, 857, 859, 450; 7/107; 81/28

[56] References Cited

U.S. PATENT DOCUMENTS

| | | | |
|---|---|---|---|
| 1,743,825 | 1/1930 | Martens | 29/258 X |
| 2,281,479 | 4/1942 | Chirelstein | 29/754 X |
| 2,593,081 | 4/1952 | Wilmot | 29/754 X |
| 3,137,062 | 6/1964 | Green et al. | 29/750 |
| 3,898,724 | 8/1975 | Conorich | 7/107 X |
| 3,955,414 | 5/1976 | Anderson | 29/747 |
| 3,964,147 | 6/1976 | Fusco et al. | 29/754 X |

FOREIGN PATENT DOCUMENTS

| | | | |
|---|---|---|---|
| 3504606 | 10/1990 | Germany | 29/748 |

*Primary Examiner*—Peter Vo
*Attorney, Agent, or Firm*—Henry M. Feiereisen

[57] ABSTRACT

A locking system for securing a cable terminal in a plug case includes a turning tool defining an axis and insertable in the plug case in such a manner that locking pins of the cable terminal are deformed and forced against projections on the plug case for preventing a displacement of the cable terminal longitudinally in direction of the axis. The turning tool has a sleeve and a stationary nut which is connected to the sleeve via a tongue and groove joint in form of several circumferentially spaced, longitudinally twisted grooves and tongues, and secured against a rotation relative to the sleeve.

5 Claims, 1 Drawing Sheet

LOCKING SYSTEM FOR SECURING A CABLE TERMINAL IN A PLUG CASE

BACKGROUND OF THE INVENTION

The present invention refers to a locking system for a cable terminal in a plug case, and in particular to a locking system including a turning tool by which locking pins of the cable terminal are deformed and forced against projections of the plug case for preventing a displacement of the cable terminal in direction of a longitudinal axis.

It is known to retain cable terminals that are securely fixed to cable ends in plug cases by elastic hooks which lock behind respectively formed parts during insertion of the cable terminals in the plug case. In order to prevent a disengagement of the cable terminal from the plug case, e.g. through repeated vibrations during operation of a motor vehicle, an additional safety mechanism is incorporated in form of locking pins which are attached to the cable terminal and twisted by a turning tool after insertion of the cable terminal in the plug case, such that the locking pins bear in form-fitting manner upon or in complementary projections. An axial displacement of the cable terminal is then effectively eliminated thereby.

The deformation of the locking pins is accomplished by a turning tool which engages the locking pins in form-fitting manner and by which the locking pins are bent when slightly turning the tool while the cable terminal remains in position. The tool is inserted into the plug case from the open end opposing the cable, and then turned. Examples for a turning tool include a sleeve slotted on one end, or a pin that is shaped on one end in form of a spade, or any other suitable design which matches the shape and configuration of the cable terminal and their locking pins.

Since turning tools of this kind are preferably incorporated in devices which simultaneously check for defective connections, as disclosed e.g. in German Patent No. DE 35 04 606, the rotation of the turning tools is suitably effected by an axial displacement of the testing unit. In order to convert the axial displacement of the testing unit into a rotational motion of the turning tool, a lateral pin is formed on the turning tool for engagement and guidance in a curved slotted guideway of a sleeve which surrounds the turning tool. A drawback of such a configuration is the spotwise support of the pin upon the side wall of the slotted guideway, because a spotwise support results in considerable wear in particular because the deformation of the locking pins requires a certain force application which unduly strains the pin and the slotted guideway and thus leads to a relatively short service life. This in turn adversely affects the production costs.

SUMMARY OF THE INVENTION

It is an object of the present invention to provide an improved locking system for securing a cable terminal in a plug case, obviating the aforestated drawbacks.

In particular, it is an object of the present invention to provide an improved locking system for securing a cable terminal in a plug case, by which the service life is significantly increased and the overall operational costs are reduced.

These objects, and others which will become apparent hereinafter are attained in accordance with the present invention by providing the turning tool with a sleeve and a nut which is prevented from rotating relative to the sleeve and secured thereto via a tongue and groove joint in form of several circumferentially spaced, longitudinally twisted tongues and grooves.

The provision of a tongue and groove joint between the sleeve and the nut results in a very low contact pressure during conversion of the axial movement into a rotational movement so that wear on these elements is minimized. This reduces operational expenses because repair work necessitated by wear is required, if at all, only after many hours of operation. Also, the tongue and groove joint results in precise alignment and guidance of the turning tool so that the overall quality of the operation is greatly enhanced.

An example for a turning tool is a pin which is slotted at the end face opposing the cable terminal and provided with longitudinally twisted grooves or tongues, with the nut being of complementary configuration i.e. with tongues or grooves.

Suitably, the nut is stationary and the turning tool is shifted in axial direction, to thereby enable a simultaneous testing for defective connections in a conventional manner. Persons skilled in the art will understand that a reversed configuration is also possible, i.e. to move the nut in axial direction and to securely clamp the turning tool to prevent a displacement in axial direction, as long as the nut is prevented from a rotation relative to the sleeve of the turning tool.

According to another feature of the present invention, the turning tool is provided with an adapter piece which is detachably secured to the sleeve at the end that faces the cable terminal for engagement with the locking pins of the cable terminal. Suitably, the adapter piece is threadably engaged on the sleeve to allow replacement thereof by another adapter piece to conform the locking system to a different cable terminal.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figures 1, 2:
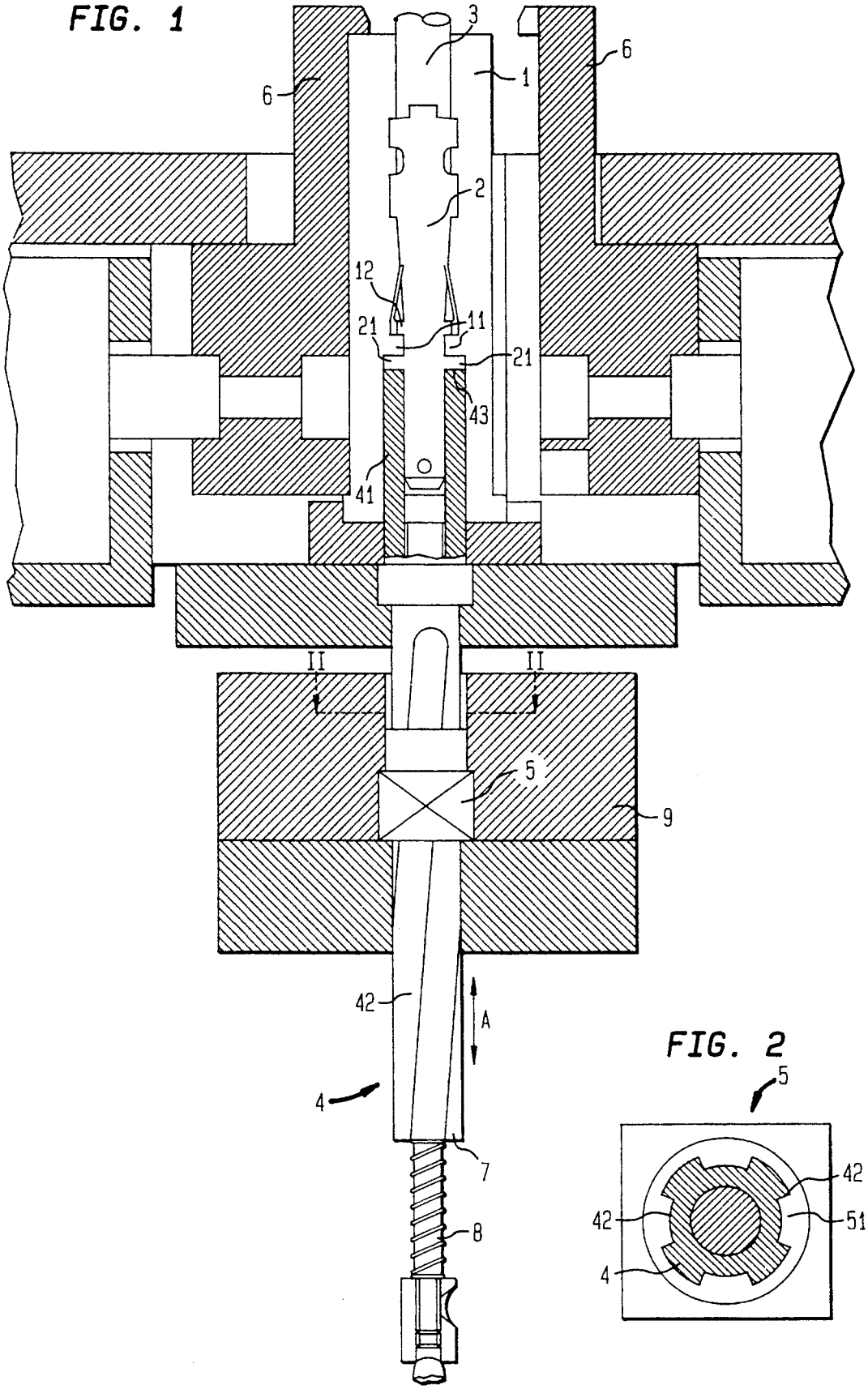
FIG. 1 is a sectional side view of one embodiment of a locking system for securing a cable terminal in a plug case, in accordance with the present invention, as part of a testing apparatus for checking defective connections.
FIG. 2 is a detailed sectional view of a the locking system taken along the line II—II in FIG. 1.

Throughout all the Figures, the same or corresponding elements are always indicated by the same reference numerals.

Turning now to the drawing, and in particular to FIG. 1, there is shown a sectional side view of one embodiment of a locking system for securing a cable terminal to a plug case 1, as part of a testing apparatus for checking defective connections of cables 3 in the plug case 1. Each cable 3 is provided on one end with a cable terminal 2 which is insertable in the plug case 1. Only one cable terminal 2 is shown in FIG. 1 for illustrative purposes.

The plug case 1 is securely fitted in a receptacle 6 and includes projections 11 which radially project inwardly from the plug case 1 and serve as stop member for projections 12 on the cable terminal 2 when the latter is inserted in the plug case 1. At its end distant to the cable 3, the plug case 1 is open and faces downwards to allow insertion of a test pin into the respective opening of the plug case 1 for contact with the cable terminal 2 to test the connection. The test pin is part of a testing device for checking cables for defective securement to the plug case 1, as e.g. disclosed in DE 35 04 606 and formed as turning tool which is generally designated by reference numeral 4 and includes a sleeve 7 that is secured upon a threaded shaft 8 for axial movement in direction of double arrow A upon the threaded shaft 8. The sleeve 7 is suitably guided for axial displacement in a bearing block 9 and is formed about its circumference with several grooves 42 which are twisted in longitudinal direction. Secured in form-fitting manner upon the sleeve 7 is a nut 5 which is stationarily held in the bearing block 9 and prevented from a rotation relative to the sleeve 7. The nut 5 has an internal profile in form of tongues 51 (FIG. 2) which are complementary to the grooves 42 of the sleeve 7.

At the end facing the cable terminal 2, the turning tool 4 carries an adapter piece 41 which is formed on its cable-near end face with a slot 43 for engagement by locking pins 21 that radially project from the cable terminal 2.

When the turning tool 4 executes a stroke in longitudinal direction, as indicated by arrow A, the twisted configuration of the grooves 42 and tongues 51 causes a rotational movement of the sleeve 7 so that the locking pins 21 in the slot 43 are bent or twisted and bear upon the projections 11 of the plug case 1. Thus, the cable terminal 2 is secured in place against a displacement in axial direction, and the turning tool 4 can now assume its function as test pin for checking the cable for defective securement to the plug case 1.

The adapter piece 41 is threadably engaged upon the shaft 8 of the turning tool 4 in order to allow a replacement thereof by another adapter piece to conform to a modified configuration of the cable terminal 2. For example, the adapter piece 41 may be replaced by a spade-shaped piece.

While the invention has been illustrated and described as embodied in a locking system for securing a cable terminal in a plug case, it is not intended to be limited to the details shown since various modifications and structural changes may be made without departing in any way from the spirit of the present invention.

What is claimed as new and desired to be protected by Letters Patent is set forth in the appended claims.

I claim:

1. A locking system for securing a cable terminal in a plug case; comprising a turning tool defining an axis and insertable in the plug case, said turning tool having a sleeve exhibiting one cable terminal proximate end which can be brought in registry with locking pins of the cable terminal, and a nut secured against rotation relative to said sleeve and connected thereto via a tongue and groove joint in form of several circumferentially spaced, longitudinally twisted tongues and complementary grooves so that upon axial displacement, the turning tool is turned to effect a twisting of the locking pins for abutment against projections on the plug case, thereby securing the cable terminal in place and preventing a displacement of the cable terminal longitudinally in direction of said axis.

2. The locking system of claim 1 wherein said turning tool is a test pin connected to a testing unit for testing defective connections between the cable terminal and the plug case.

3. The locking system of claim 1 wherein said turning tool has an adapter piece detachably positioned at an end thereof facing the cable terminal for engagement with said locking pins.

4. The locking system of claim 3 wherein said turning tool has a shaft operatively connected to said sleeve, said adapter piece being threadably engaged on said shaft.

5. The locking system of claim 1 wherein said nut is secured to said sleeve such as to be prevented from executing a displacement longitudinally in direction of said axis.

* * * * *